US007176750B2

(12) United States Patent
Oddone et al.

(10) Patent No.: US 7,176,750 B2
(45) Date of Patent: Feb. 13, 2007

(54) METHOD AND APPARATUS FOR FAST POWER-ON OF THE BAND-GAP REFERENCE

(75) Inventors: Giorgio Oddone, Genoa (IT); Stefano Sivero, Vergiate (IT); Giorgio Bosisio, Robbiate (IT); Andrea Bettini, Cavenagio Brianza (IT)

(73) Assignee: Atmel Corporation, San Jose, CA (US)

( * ) Notice: Subject to any disclaimer, the term of this patent is extended or adjusted under 35 U.S.C. 154(b) by 0 days.

(21) Appl. No.: 11/124,871

(22) Filed: May 9, 2005

(65) Prior Publication Data

US 2006/0038609 A1 Feb. 23, 2006

(30) Foreign Application Priority Data

Aug. 23, 2004 (IT) ..... MI2004A1665

(51) Int. Cl.
*G05F 1/10* (2006.01)

(52) U.S. Cl. ..... 327/539; 327/143

(58) Field of Classification Search ..... 327/142, 327/143, 530, 534, 535, 539
See application file for complete search history.

(56) References Cited

U.S. PATENT DOCUMENTS 5,298,851 A 3/1994 DeNardis
5,506,496 A 4/1996 Wrathall et al.
5,510,699 A 4/1996 Theus et al.
5,559,424 A 9/1996 Wrathall et al.
5,712,890 A * 1/1998 Dries et al. ..... 327/539
6,097,179 A 8/2000 Ray et al.
6,380,721 B2 4/2002 Pattamatta et al.
6,407,638 B1 6/2002 Migliavacca
6,414,472 B1 7/2002 Cocetta
6,507,178 B2 1/2003 Cocetta et al.
6,642,776 B1 * 11/2003 Micheloni et al. ..... 327/539
6,906,581 B2 * 6/2005 Kang et al. ..... 327/539
2003/0128560 A1 7/2003 Saiki et al.
2003/0222706 A1 12/2003 Enriquez et al.
2004/0001357 A1 1/2004 Pekny

* cited by examiner

*Primary Examiner*—Jeffrey Zweizig
(74) *Attorney, Agent, or Firm*—Sawyer Law Group LLP

(57) ABSTRACT

A fast power-on band-gap reference circuit includes a buffer, a first band-gap logic, and a second high drive band-gap logic. During power-on of the band-gap reference circuit, both the first band-gap logic and the second high drive band-gap logic are activated, in which the first band-gap logic charges an output of the first band-gap logic and the second high drive band-gap logic charges a capacitance associated with an output of the band-gap reference circuit. When the output of the first band-gap logic reaches a predetermined value, the second high drive band-gap logic is deactivated and the output of the first band-gap logic is couple to the output of the band-gap reference circuit through the buffer.

6 Claims, 2 Drawing Sheets

METHOD AND APPARATUS FOR FAST POWER-ON OF THE BAND-GAP REFERENCE

CROSS-REFERENCE TO RELATED APPLICATIONS

This application claims benefit under 35 USC 119 of Italian Application no. M12004A 001665, filed on Aug. 23, 2004.

1. Field of the Invention

The present invention relates to band-gap reference circuits, and more particularly to the power-on of the band-gap reference circuit.

1. Background of the Invention

During power-on of an electronic device, some circuits require a certain amount of time to reach a functional state in a stable manner. One such circuit is the band-gap voltage reference circuit. The band-gap voltage is used in different circuits inside a memory device. Particularly, it is used in the regulators that control the pumps output voltages. The band-gap voltage should be at its proper value in a short time to avoid the pumps reaching a higher-than-desired value. However, many conventional band-gap reference circuits do not have high drive capabilities. Thus, it is very difficult for these circuits to reach the desired stable reference voltage quickly, i.e., in microseconds. Moreover, with the continuing increase in memory size and the use of the band-gap voltage in many other circuits, the capacitance of the band-gap voltage line is increased as well, requiring high drive capability of the band-gap circuitry.

Accordingly, there exists a need for a method and apparatus for fast power-on of a band-gap reference circuit. Upon power-on, this method and apparatus should reach the desired stable reference voltage in microseconds, charging the band-gap voltage high capacitive line. The present invention addresses such a need.

SUMMARY OF THE INVENTION

A fast power-on band-gap reference circuit includes a band-gap logic and a high drive band-gap logic. During power-on, both the band-gap logic and the high drive band-gap logic are activated and charges a capacitance of a band-gap line. When an output of the band-gap logic reaches a predetermined value, the high drive band-gap logic is deactivated. Thus, the high drive band-gap logic, with a high drive capability, charges the band-gap capacitance at the same time the band-gap logic starts to generate the compensate temperature voltage. In this manner, the band-gap reference circuit reaches its stable, functional state faster than conventional circuits, in the range of a few microseconds.

DETAILED DESCRIPTION

The present invention provides a method and apparatus for fast power-on of a band-gap reference circuit. The following description is presented to enable one of ordinary skill in the art to make and use the invention and is provided in the context of a patent application and its requirements. Various modifications to the preferred embodiment will be readily apparent to those skilled in the art and the generic principles herein may be applied to other embodiments. Thus, the present invention is not intended to be limited to the embodiment shown but is to be accorded the widest scope consistent with the principles and features described herein.

Figure 1:
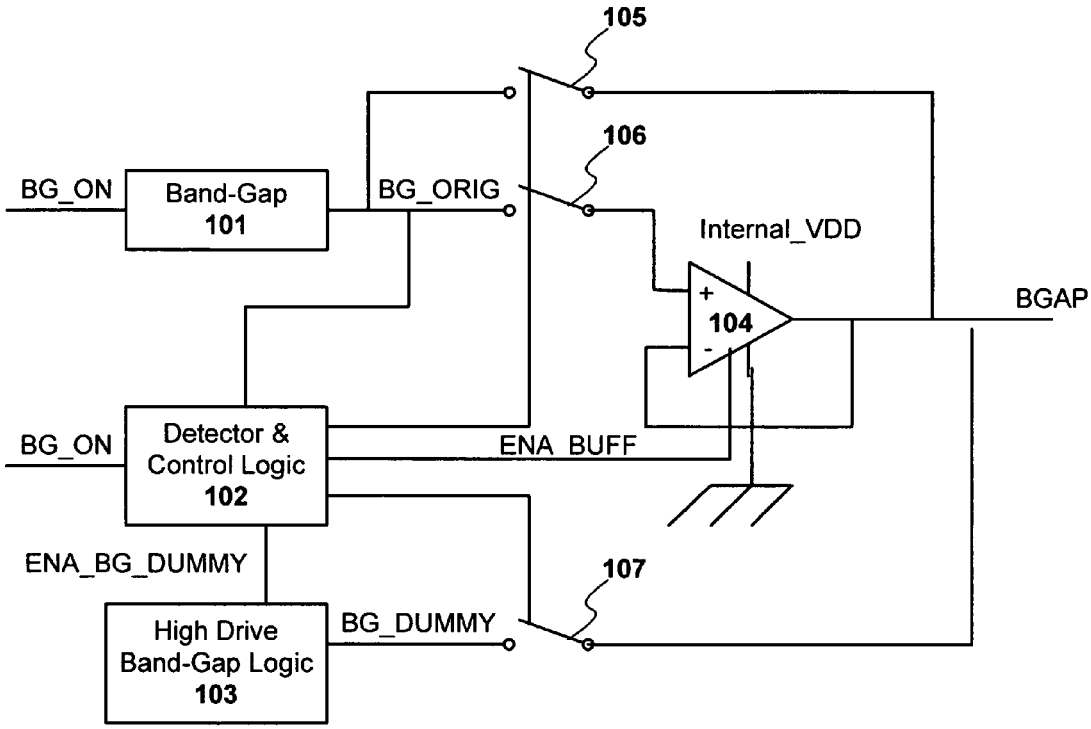
FIG. 1 illustrates a preferred embodiment of a fast power-on band-gap reference circuit in accordance with the present invention.

To more particularly describe the features of the present invention, please refer to FIGS. 1 and 2 in conjunction with the discussion below.

The band-gap reference circuit in accordance with the present invention utilizes a high drive band-gap logic with a high drive capability to charge the band-gap capacitance of the line while the true band-gap logic starts to generate the compensated temperature voltage. FIG. 1 illustrates a preferred embodiment of a fast power-on band-gap reference circuit in accordance with the present invention. The band-gap reference circuit includes the band-gap logic 101, a detector and control logic 102, a high drive band-gap logic 103, and a buffer 104, coupled as shown. The band-gap logic 101 receives a BG_ON signal as an input and outputs a BG_ORIG signal. The BG_ORIG signal is capable of being coupled to the buffer 104 or directly to the band-gap output (BGAP). The detector and control logic 102 also receives the BG_ON signal as an input. The detector and control logic 102 outputs signals to control the switches 105–107, a signal (ENA_BUFF) to control the buffer 104, and a signal (ENA_BG_DUMMY) to control the high drive band-gap dummy logic 103. The high drive band-gap logic 103 receives the ENA_BG_DUMMY signal from the detector and control logic 102 as an input and outputs a BG_DUMMY signal. BG_DUMMY signal is capable of being connected directly to the BGAP. The power-on voltage is represented by VDD.

Figure 2:
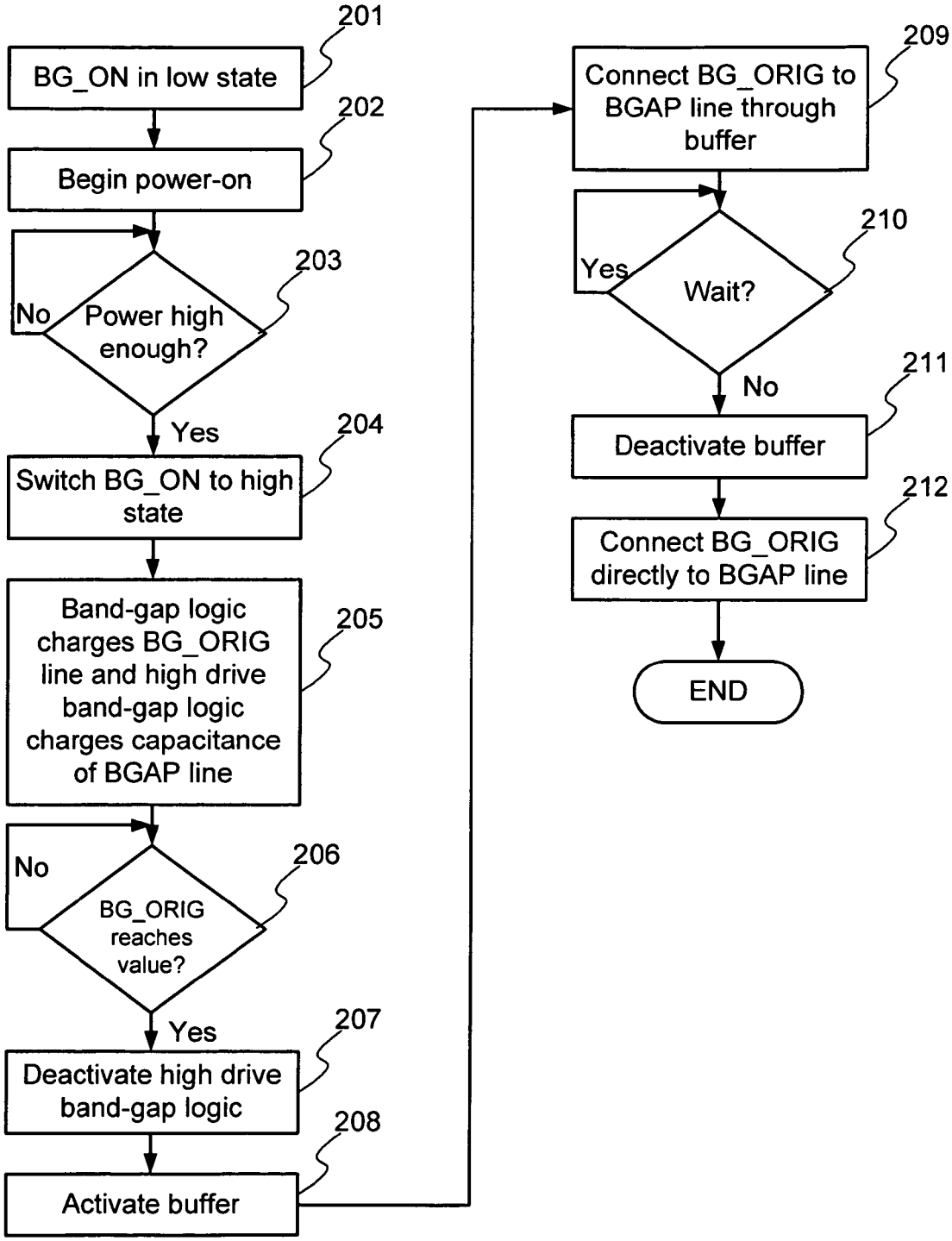
FIG. 2 is a flowchart illustrating a preferred embodiment of a method for fast power-on of a band-gap reference circuit in accordance with the present invention.

FIG. 2 is a flowchart illustrating a preferred embodiment of a method for fast power-on of a band-gap reference circuit in accordance with the present invention. The BG_ON signal begins in a low state, via step 201. The band-gap reference circuit is then powered-on, via step 202. When the power is high enough to start generating the compensate temperature voltage, via step 203, the BG_ON signal is switched from its low state to a high state, via step 204. At this point, both the band-gap logic 101 and the high drive band-gap logic 103 are activated, via step 205. The band-gap logic 101 generates the BG_ORIG voltage value and charges only a small capacitor placed locally. The high drive band-gap logic 103 charges a high capacitance of the band-gap (BGAP) line. Here, the high drive band-gap logic 103 has a high drive capability to charge the band-gap capacitance at the same time the band-gap logic 101 starts to generate the temperature compensated voltage.

When BG_ORIG reaches the appropriate value, via step 206, the detector and control logic 102 deactivates the high drive band-gap logic 103, via step 207, and activates the buffer 104, via step 208. The detector and control logic 102 connects BG_ORIG to the BGAP line through the buffer 104, via step 209, by having the switch 106 closed and the switch 105 open. After waiting a predetermined amount of time, via step 210, the detector and control logic 102 deactivates the buffer 104, via step 211, and connects BG_ORIG directly to the BGAP line, via step 212, by having the switch 105 closed and the switch 106 open.

Here, the high drive band-gap logic 103 depends upon the temperature and in part on VDD. The buffer 104 is used to provide the current when the voltage value of the band-gap line previously charged by the high drive band-gap logic 103 is lower than BG_ORIG, and to sink the current when it is higher than BG_ORIG. The buffer 104 is also used to externally measure the value of the BGAP line. To avoid problems of clock feedthrough, all the switches 105–107 are compensated with a dummy switch (not shown), and a careful layout of the circuit is adopted to limit the clock feedthrough. To further reduce errors introduced by the buffer 104 during external measurements, and mismatches in all the circuitry, common centroid structure is used for the transistors in the circuit and for the dummy structure.

A fast power-on band-gap reference circuit has been disclosed. This circuit uses a high drive band-gap logic with a high drive capability to charge the band-gap capacitance at the same time the band-gap logic starts to generate the compensate temperature voltage. In this manner, the band-gap reference circuit reaches its stable, functional state faster than conventional circuits, in the range of a few microseconds.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A fast power-on band-gap reference circuit, comprising:

a buffer;

a first band-gap logic; and a second high drive band-gap logic, wherein during power-on of the band-gap reference circuit, the first band-gap logic is activated and charges an output of the first band-gap logic, and the second high drive band-gap logic is activated and charges a capacitance associated with an output of the band-gap reference circuit, and wherein when the output of the first band-gap logic reaches a predetermined value, the second high drive band-gap logic is deactivated and the output of the first bandgap logic is coupled to the output of the band-gap reference circuit through the buffer.

2. The band-gap reference circuit of claim 1, wherein after a predetermined period of time, the buffer is deactivated and the output of the first band-gap logic is directly coupled to the output of the band-gap reference circuit.

3. The band-gap reference circuit of claim 1, further comprising:

a detector and control logic for activating and deactivating the first band-gap logic and the second high drive band-gap logic.

4. A fast power-on band-gap reference circuit, comprising:

a first band-gap logic;

a second high drive band-gap logic, wherein during power-on of the band-gap reference circuit, both the first band-gap logic and the second high drive band-gap logic are activated in which the first band-gap logic charges an output of the first band-gap logic and the second high drive band-gap logic charges a capacitance associated with an output of the band-gap reference circuit, wherein when the output of the first band-gap logic reaches a predetermined value, the second high drive band-gap logic is deactivated;

a buffer coupled to the output of the band-gap reference circuit, wherein when the output of the first band-gap logic reaches the predetermined value, the buffer is activated and the output of the first band-gap logic is coupled to the output of the band-gap reference circuit through the buffer, wherein after a predetermined period of time the buffer is deactivated and the output of the first band-gap logic is directly coupled to the output of the band-gap reference circuit; and a detector and control logic for activating and deactivating the first band-gap logic, the second high drive band-gap logic, and the buffer.

5. A method for fast power-on of a band-gap reference circuit, the method comprising:

charging an output of a first band-gap logic associated with the band-gap reference circuit;

charging a capacitance associated with an output of the band-gap reference circuit using a second high drive band-gap logic associated with the band-gap reference circuit;

determining if the output of the first band-gap logic has reached a predetermined value; and responsive to the output of the first band-gap logic reaching the predetermined value, deactivating the second high drive band-gap logic, activating a buffer, and coupling the output of the first band-gap logic to the output of the band-gap reference circuit through the buffer.

6. The method of claim 5, further comprising:

after a predetermined period of time, deactivating the buffer and directly coupling the output of the first band-gap logic to the output of the band-gap reference circuit.

* * * * *